US008282778B2

(12) United States Patent
Kolari

(10) Patent No.: US 8,282,778 B2
(45) Date of Patent: Oct. 9, 2012

(54) PREVENTION OF BACTERIAL SPORE FORMATION IN A BROKE SYSTEM OF A BOARD MACHINE

(75) Inventor: Marko Kolari, Vantaa (FI)

(73) Assignee: Kemira Oyj, Helsinki (FI)

( * ) Notice: Subject to any disclaimer, the term of this patent is extended or adjusted under 35 U.S.C. 154(b) by 713 days.

(21) Appl. No.: 12/293,116

(22) PCT Filed: Mar. 15, 2007

(86) PCT No.: PCT/FI2007/000064

§ 371 (c)(1),
(2), (4) Date: Jul. 1, 2009

(87) PCT Pub. No.: WO2007/125154

PCT Pub. Date: Nov. 8, 2007

(65) Prior Publication Data

US 2009/0294082 A1 Dec. 3, 2009

(30) Foreign Application Priority Data

Mar. 16, 2006 (FI) ..... 20060247

(51) Int. Cl.
*D21H 17/07* (2006.01)
*D21H 21/02* (2006.01)

(52) U.S. Cl. ..... 162/161; 162/158; 162/191

(58) Field of Classification Search ..... 162/158, 162/161, 192
See application file for complete search history.

(56) References Cited

U.S. PATENT DOCUMENTS

| | | | | |
|---|---|---|---|---|
| 5,415,736 | A * | 5/1995 | Grether | 162/111 |
| 6,096,225 | A | 8/2000 | Yang et al. | |
| 6,525,169 | B1 * | 2/2003 | Farrar | 528/393 |
| 6,998,015 | B2 * | 2/2006 | Hua et al. | 162/83 |

FOREIGN PATENT DOCUMENTS

| | | | |
|---|---|---|---|
| CN | 1316979 | A | 10/2001 |
| EP | 0 799 928 | A3 | 7/1998 |
| GB | 1268558 | | 3/1972 |
| WO | 01/06877 | A1 | 2/2001 |
| WO | 02/078450 | A1 | 10/2002 |

OTHER PUBLICATIONS

Charney, J. et al., Manganese is an essential element for sporulation in the genus *Bacillus*, Journal of Bacteriology 62, 1951, pp. 145-148.

(Continued)

*Primary Examiner* — Matthew Daniels
*Assistant Examiner* — Dennis Cordray
(74) *Attorney, Agent, or Firm* — Thomas, Kayden, Horstemeyer & Risley, LLP

(57) ABSTRACT

The invention relates to a method for preventing or delaying bacterial sporulation in the broke system of a board or paper machine by lowering the content of transition metals in the broke to a level unfavorable for sporulation. Preferably bacterial cells present in the broke system of the board or paper machine are not substantially killed by the procedure used for lowering the content of the transition metals. The invention further relates to a method for producing packaging board or packaging paper having a low bacterial spore content.

20 Claims, 5 Drawing Sheets

OTHER PUBLICATIONS

Fortnagel, P. et al., Inhibition of aconitase by chelating of transition metals causing inhibition of sporulation in *Bacillus subtilis,* The Journal of Biological Chemistry 243, 1968, pp. 5289-5295.
Francis, C.A. and Tebo, B.M., Enzymatic manganese (II) oxidation by metabolically dormant spores of diverse *Bacillus* species, Applied and Environmental Microbiology 68, 2002, pp. 874-880.
Fujita, M. et al., High- and low-threshold genes in the Spo0A regulon of *Bacillus subtilis,* Journal of Bacteriology 187, 2005, pp. 1357-1368.
Gonzalez-Pastor et al., Cannibalism by sporulating bacteria, Science 301, 2003, pp. 510-513.
Inaoka, T. et al., SodA and manganese are essential for resistance to oxidative stress in growing and sporulating cells of *Bacillus subtilis,* Journal of Bacteriology 181, 1999, pp. 1939-1943.
Kujala, M. et al., A Method to leach manganese and some other metal cations from pulp matrix to aqueous phase for the subsequent ICP-AES analysis: a potential tool for controlling the metal profile in a pulp bleaching process, Journal of Cleaner Production 12, 2004, pp. 707-712.
Que, Q. and Helmann, J.D., Manganese homeostasis in Bacillus subtillis is regulated by MntR, a bifunctional regulator related to the diphtheria toxin repressor family proteins, Molecular Microbiology 35, 2000, p. 1454-1468.
Turner, N.A. et al., Microbial differentiation and changes in susceptibility to antimicrobial agents, Journal of Applied Microbiology 89, 2000, pp. 751-759.
Vasantha, N. and Freese, E., The role of manganese in growth and sporulation of *Bacillus subtilis,* Journal of General Microbiology 112, 1979, pp. 329-336, Abstract, 1 page.
Bibliographic data for CN1316979A, downloaded Jul. 27, 2011; http://worldwide.espacenet.com/publicationDetails/biblio? CC=CN &NR=1316979A&KC=... 1 Page.

* cited by examiner

PREVENTION OF BACTERIAL SPORE FORMATION IN A BROKE SYSTEM OF A BOARD MACHINE

CROSS REFERENCE TO RELATED APPLICATIONS

This is a U.S. national stage of application No. PCT/FI2007/000064, filed on 15 Mar. 2007. Priority under 35 U.S.C. §119(a) and 35 U.S.C. §365(b) is claimed from Finland Patent Application No. 20060247, filed 16 Mar. 2006, the disclosure of which is also incorporated herein by reference.

DESCRIPTION OF THE INVENTION

The invention relates to the prevention or delay of bacterial spore formation in the broke system of a board or paper machine. The primary site for bacterial spore formation in a board or paper machine is the broke circulation. Transformation of bacteria into spores, or sporulation, in the broke system of a board or paper machine may be prevented by the invention. The invention further relates to a method for producing packaging board or packaging paper having a low bacterial spore content, wherein broke is used for producing the packaging board or packaging paper.

BACKGROUND OF THE INVENTION

Particularly for machines producing liquid packaging board, or other food-grade packaging boards, a low bacterial spore content in the final product is an important quality factor. Spore forming bacterial cells are normally present in the environment of the board machine either as vegetative cells multiplying by cell division (vegetative form), or as a spore-form very resistant to harsh environmental conditions (dormant form surviving for years). Transformation of bacterial cells from the vegetative form into the resistant dormant form is called sporulation, whereas the retransformation of bacterial spore to give vegetative cell is called germination. In some board machines, low spore contents of the final product are difficult to achieve due to excessive bacterial sporulation. Eradication of mature spores requires high biocide concentrations, and accordingly, the prevention of the bacterial cells from sporulating would be more efficient in comparison to killing of mature spores. In case the bacterial sporulation is prevented, the cells in the process remain in the vegetative state, thus being more sensitive to biocides and killed by high temperatures of the drying section at the latest.

Factors influencing bacterial cell sporulation and germination are widely studied. It is known that sporulation is a relatively strictly controlled process that may not be stopped once initiated. Moreover, cells only sporulate under environmental stress, for instance when starving. Recently González-Pastor et al. (2003) showed that in a shortage of nutrients *Bacillus subtilis* bacteria, first try to delay sporulation by cannibalism. So-called skf (sporulation killing factor) and sdp (sporulation delay protein) genes are activated in cells starving first, causing secretion of cytotoxic agents and death of the surrounding sister cells. Nutrients released from the dead cells were utilized by the surviving ones. Fujita et al. (2005) showed that the initiation of sporulation depends on the so-called Spo0A control unit controlling the expression of about 121 genes involved in sporulation. Increase of the Spo0A protein first resulted in the control of genes supporting growth, thus causing e.g. killing of sister cells, utilization of released nutrients and increased biofilm formation, the actual sporulation process proceeding only later.

There are several studies directed to the resistance of mature spores to environmental stress factors. Turner et al. (2000) have studied the influence of antimicrobial agents on mature spores of the *Bacillus subtilis* bacteria. Efficiency of biocides was reduced as the cortex, inner and outer coats of the spores were finished during progressing sporulation. In the early stages of sporulation, the spores were resistant to toluene, formaldehyde, phenol, and phenylmercuric nitrate. Once the spore cortex was ready, the spores were resistant to chlorohexidine diacetate (CHA), quaternary ammonium compounds (QAC), and compounds releasing chlorine. In the final stage of sporulation, once the inner and outer spore coats were finished, resistances to the lysozyme enzyme and glutaraldehyde were also found. Resistance to biocides of mature spores is considerably greater than that of bacterial cells in the vegetative state. Finished board may not contain too high residual amounts of biocides, and accordingly, applied biocide amounts are limited for several board machines, thus preventing in practice the use of biocides in amounts necessary for the eradication of mature spores. Heat-resistant spores also survive the high temperatures of the drying section of the board machine, which are normally lethal to vegetative cells.

Several metal ions including manganese are involved in the growth, sporulation and germination of microbes. Several studies about the influence of various metals on different enzymatic activities may be found in the literature. Charney et al. (1951) showed that manganese is an important transition metal in the sporulation of the *Bacillus subtilis* bacteria. In this study, no sporulation of the bacterium took place in a growth medium very rich in nutrients but having a low manganese concentration. The amount of sporulating cells was increased by the manganese addition of 0.1 ppm or more. Vasantha and Freese (1979) examined the role of manganese in the growth and sporulation of the *Bacillus subtilis* bacteria. Manganese was shown to be an important metal for the activity of the phosphoglycerate phosphomutase enzyme during sporulation. Sporulation was successful in the absence of manganese only if glucose, malate and decoyinine inhibitor were added to the medium, said inhibitor preventing the formation of guanosine monophosphate synthase thus avoiding 3-phosphoglyceridic acid metabolic pathway. Accordingly, cells need manganese for normal sporulation pathway. Inaoka et al. (1999) showed that the SodA (superoxide dismutase) enzyme of the *Bacillus subtilis* bacteria in combination with manganese protected cells against external oxidants both in the growth and sporulation stages, that is, manganese is also an important cell protection factor. Que and Helmann (2000) showed that mnt genes of the *Bacillus subtilis* bacteria are involved in the transportation of manganese. Mutation of these genes prevented manganese transportation causing reduced sporulation in comparison to the sporulation of wild type strains. The amount of sporulating cells of the wild type strain was about 2.6% for a 0.006 ppm manganese addition, said amount being 39% in case 0.8 ppm of manganese was added. Accordingly, the addition of manganese clearly increased sporulation.

Metabolism of a bacterial spore is known to be rather minute. However, even in their dormant stage, spores have an influence on manganese present in their environment. Francis and Tebo (2002) showed that enzymes able to oxidize manganese from the soluble Mn(II) form to the insoluble Mn(IV) form may be isolated from the surface of the spores.

The fact that the growth of microbes may be limited by chelating iron and other metals has already been known for a long time, but however, chelates are typically not used for this purpose since necessary concentrations thereof are often very high. For instance in board machines, various biocides are used for microbial growth inhibition. Fortnagel and Freese (1968) have studied the influence of chelates on sporulation. They showed in a basic research directed to the mechanism of the sporulation of the *Bacillus subtilis* bacteria that sporulation could be stopped by chelators binding transition metals, thus inhibiting the aconitase enzyme. Growth was not inhibited by alpha picolinic acid concentrations of less than 1 mM (<123 ppm), whereas a concentration of 0.4 mM reduced sporulation. Aconitase enzyme was also inhibited by concentrations of less than 1 mM of quinaldic acid, o-phenanthroline, and dipyridyl.

In paper industry, chelation of manganese has been studied with respect to bleaching processes. The purpose of the study by Kujala et al. (2004) was the reduction of the amount of manganese naturally present in wood during pulping process since it decomposes hydrogen peroxide used for pulp bleaching. Manganese was best chelated by DTPMP, one of four chelating agents used in the study, i.e. NTA (nitrilotriacetic acid), EDTA (ethylenediaminetetraacetic acid), DTPA (diethylenetriaminepentaacetic acid) and DTPMP (diethylenetriamine-pentakis methylenephosphonic acid), with a chelating performance of over 95%.

BRIEF DESCRIPTION OF THE INVENTION

The invention relates to suppressing bacterial sporulation in the broke system of a board or paper machine by reducing the concentration of bivalent transition metals, especially manganese, controlling the sporulation to a level preventing sporulation without killing the bacteria in the broke system. This is particularly efficiently achieved by using a combination of a chelating agent and a dispersing agent.

BRIEF DESCRIPTION OF THE DRAWINGS

The invention is now described referring to appended drawings.

DETAILED DESCRIPTION OF THE INVENTION

Figure 1:
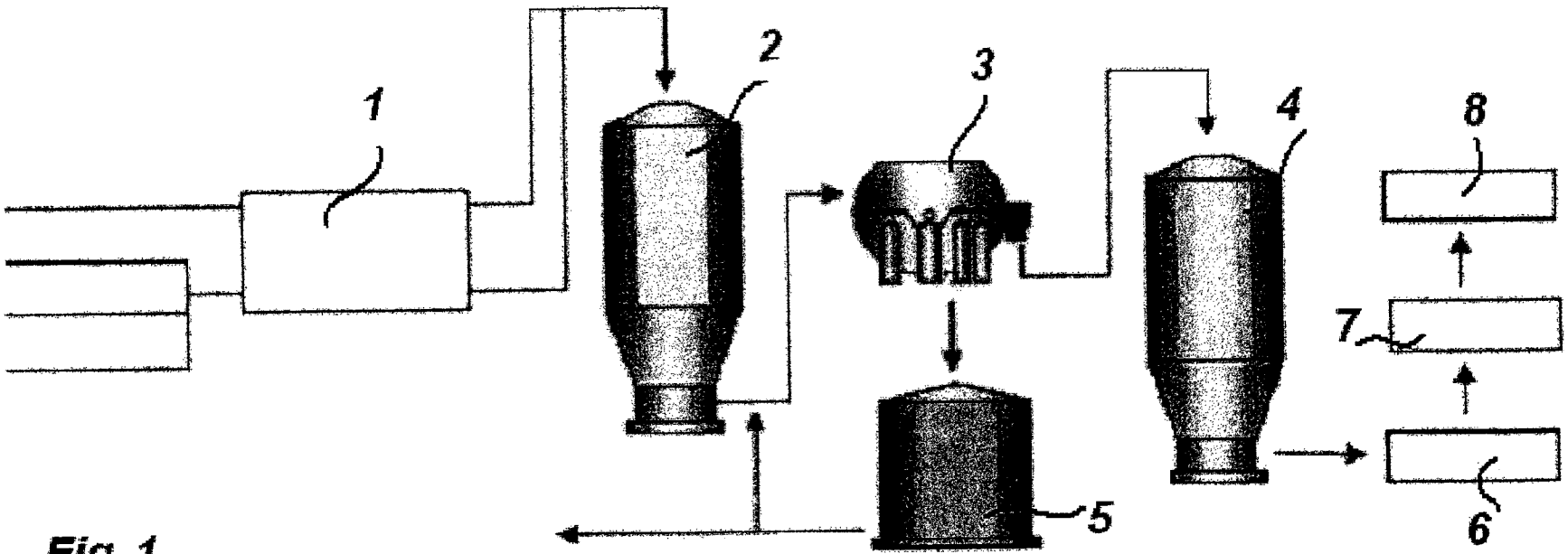
FIG. 1 shows a simplified scheme of different stages typical for broke systems of board or paper machines.

The inventor has found that the broke circulation is the primary site for spore formation in board machines. The inventor has also found that the total amount of bacteria in the broke tank may remain at the same level for several days, while simultaneously the proportion of the sporulating bacteria may vary considerably. Based on measurements, concentrations of the bivalent manganese and bivalent iron in the broke system vary between microbiologically significant concentration values. The inventor has found that the sporulation of bacteria present in board machines is specifically controlled by manganese content, and further, that a low manganese content is a factor limiting sporulation. Sporulation of bacteria in the broke system of the board machine increases as concentrations of the bivalent manganese and/or bivalent iron increase. Higher amounts of manganese seem to be necessary for early stages of bacterial sporulation than for normal living activities. It has thus been found that sporulation may be prevented by removing a small portion of the manganese amount by chelation not influencing viability of the cells. Accordingly, minor reduction of the concentrations of the bivalent manganese and bivalent iron results in lower levels of bacterial spores both in the broke system of the board machine and in the final product without directly killing bacterial cells (non-biocidal method to control microbes).

Accordingly, the invention provides for a method for preventing or delaying bacterial sporulation in the broke system of a board or paper machine by lowering the content of transition metals in the broke to a level unfavorable for sporulation.

Further, the invention provides for a method for producing packaging board or packaging paper having a low bacterial spore content, wherein broke is used for producing the packaging board or packaging paper, said method comprising the lowering of the content of transition metals in the broke to a level unfavorable for sporulation.

According to a preferred embodiment, bacterial cells present in the broke system of the board or paper machine are not substantially killed by the procedure used for lowering the content of the transition metals.

Said procedure for lowering transition metal contents may comprise chelation or electrochemical oxidation.

In the present invention, the expression "lowering the content of the transition metals" primarily refers to reduction of the concentrations of free transition metal ions. In case chelating agents are used, concentrations of transition metals are lowered as a result of the binding of said transition metal ions by said chelating agents.

The invention mainly concerns broke systems of board machines producing packaging board, particularly board for food packaging application, primarily liquid packaging board. Boards of the said type normally have multilayer structures where the board produced according to the invention preferably is placed in the middle of the multilayer structure, for instance in case of a structure having three layers, between the top and back layers. Said top and back layers may for instance be produced from bleached chemical pulp. Such packaging boards may thus comprise 10 to 25% of the top layer, 50 to 80% of the board containing broke, and 10 to 25% of the back layer, by weight. As is known, packaging boards may also comprise aluminium foil layer(s) and/or polymer layer(s).

The invention also relates to the broke system of a paper machine producing hygiene papers, or packaging papers useful for instance for food packages, medicament packages, protective wrappings for aseptic materials, in cigarette industry or other applications where microbiological purity is required for the finished product.

*Bacillus, Paenibacillus, Brevibacillus*, and *Alicyclobacillus* are bacterial genus capable of aerobic sporulation.

According to the invention, the content of transition metals may be lowered by chelation. A chelating agent having a formula I, II, III, IV, V, or VI shown below or any other chelating agent described below may be used for chelation.

A preferred chelating agent is a compound having following general formula:

I

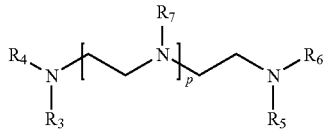

wherein p is 0 or an integer from 1 to 10, $R_3$, $R_4$, $R_5$, $R_6$, and $R_7$ are independently a hydrogen atom or an alkyl chain with 1 to 6 carbon atoms, containing one or more active chelating ligands such as a carboxyl, phosphonic or hydroxyl group or groups, or a salt thereof.

Said alkyl chain is preferably methylene —$CH_2$— or ethylene —$CH_2CH_2$—.

In formula I, $R_3$, $R_4$, $R_6$, and $R_7$ are preferably identical groups.

Chelating agents of the above formula I include polyaminopolycarboxylic acids and polyaminopolymethylene phosphonic acids.

Polyaminopolycarboxylic acids may be produced by typical methods from polyamine and formaldehyde and sodium cyanide or hydrogen cyanide. A more suitable method for small scale production is to use halogenated acetic acid, particularly monochloroacetic acid as the starting material.

Preferred polyaminopolycarboxylic acids include:

DTPA: p=1; $R_3$=$R_4$=$R_5$=$R_6$=$R_7$=—$CH_2COOH$

TTHA: p=2; $R_3$=$R_4$=$R_5$=$R_6$=$R_7$=—$CH_2COOH$

EDTA: p=0; $R_3$=$R_4$=$R_5$=$R_6$=—$CH_2COOH$

HEDTA: p=0; $R_3$=$R_4$=$R_5$=—$CH_2COOH$, $R_5$=—$CH_2CH_2OH$

EDDS: p=0; $R_3$=$R_5$=H, $R_4$=$R_6$=—$CH(COOH)CH_2COOH$ (ethylenediaminedisuccinic acid)

Polyaminopolymethylene phosphonic acids are produced in a conventional manner from a corresponding polyamine, formaldehyde and phosphonic acid. In case of higher amines, complete substitution with acetic acid groups or methylenephosphonic acid groups is increasingly difficult.

Preferred polyaminopolymethylene phosphonic acids include:

DTPMPA: p=1; $R_3$=$R_4$=$R_5$=$R_6$=$R_7$=—$CH_2POO_2H_2$

TTHMPA: p=2; $R_3$=$R_4$=$R_5$=$R_6$=$R_7$=—$CH_2POO_2H_2$

EDTMPA: p=0; $R_3$=$R_4$=$R_5$=$R_6$=—$CH_2POO_2H_2$

Another preferred chelating agent is a compound having following general formula:

II

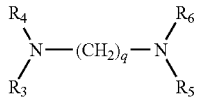

wherein q is an integer from 3 to 10, $R_3$, $R_4$, $R_5$, and $R_6$ are independently a hydrogen atom or an alkyl chain with 1 to 6 carbon atoms, containing one or more active chelating ligands such as a carboxyl, phosphonic or hydroxyl group or groups, or a salt thereof.

Said alkyl chain is preferably methylene —$CH_2$— or ethylene —$CH_2CH_2$—.

In formula II, $R_3$, $R_4$, $R_5$, and $R_6$ are preferably identical groups.

The group —$(CH_2)_q$— may also represent a cyclic structure such as a cyclohexane ring. 1,2-diaminocyclohexane tetraacetic acid (DCTA) is an example of such a chelating agent.

Chelating agents of the above formula II include hexamethylene-diaminetetra(acetic acid) (q=6) and tetramethylene-diaminetetra(methylenephosphonic acid) (q=4), both of which are commercially available and have the formulas below:

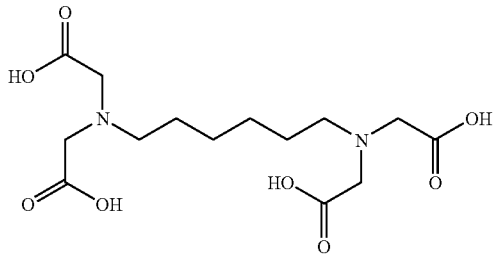

hexamethylenediaminetetra (acetic acid)

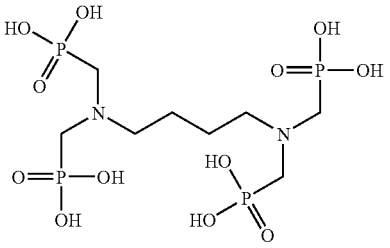

tetramethylenediaminetetra (methylenephosphonic acid)

A third preferred chelating agent is a compound having following general formula:

$R_3(R_4)NR_5$ III wherein $R_3$, $R_4$ and $R_5$ are independently a hydrogen atom or an alkyl chain with 1 to 6 carbon atoms, containing one or more active chelating ligands such as a carboxyl, phosphonic or hydroxyl group or groups, or a salt thereof.

Said alkyl chain is preferably methylene —$CH_2$— or ethylene —$CH_2CH_2$—.

In formula III, $R_3$, $R_4$, and $R_5$ are preferably identical groups.

Examples of the chelating agents of the formula III above include the commercially available nitrilotriacetic acid (NTA): $R_3$=$R_4$=$R_5$=—$CH_2COOH$.

Still another preferred chelating agent is a compound having following general formula:

IV

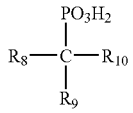

wherein $R_8$ represents a hydrogen atom, an alkyl group with 1 to 6 carbon atoms, or an alkyl chain with 1 to 6 carbon atoms, containing a carboxyl, phosphonic or hydroxyl group, $R_9$ represents a hydrogen atom, hydroxyl group, phosphonic group, carboxyl group, or an alkyl chain with 1 to 6 carbon atoms, containing one or two carboxyl groups, and $R_{10}$ represents a hydrogen atom, hydroxyl group, carboxyl group, an alkyl group with 1 to 6 carbon atoms, or an alkyl chain with 1 to 6 carbon atoms, containing a carboxyl group or a salt thereof.

Said alkyl chain is preferably methylene —$CH_2$— or ethylene —$CH_2CH_2$—.

Examples of chelating agents of the above formula IV not containing nitrogen include 1-hydroxyethyliden-1,1-diphosphonic acid (HEDP).

Still another preferred chelating agent is a compound having following general formula:

V

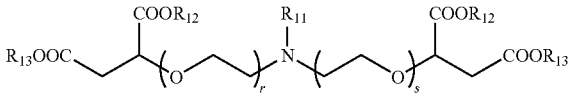

wherein $R_{11}$ represents a hydrogen atom, an alkyl chain with 1 to 30 carbon atoms, an alkyl chain with 1 to 30 carbon atoms and with 1 to 10 carboxylic acid groups bound to said chain, or an alkali metal or alkaline earth metal salt thereof, an alkyl chain with 1 to 30 carbon atoms and with 1 to 10 carboxylic acid ester groups bound to said chain, a (poly)ethoxylated hydrocarbon chain with 1 to 20 ethoxyl groups, or a carboxylic acid amide with 1 to 30 carbon atoms, wherein the N—$R_{11}$-bond is an amide bond, $R_{12}$ and $R_{13}$ are: hydrogen, an alkali metal ion or an alkaline earth metal ion or an alkyl group having 1 to 30 carbon atoms, r is 0 or 1, and s is 0 or 1.

The following N-bis- or tris-[(1,2-dicarboxy-ethoxy)ethyl] amines of the formula V are preferred:

A

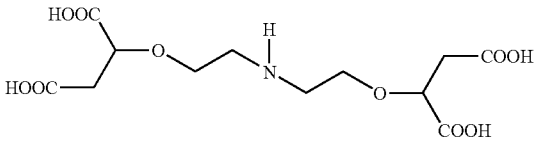

B

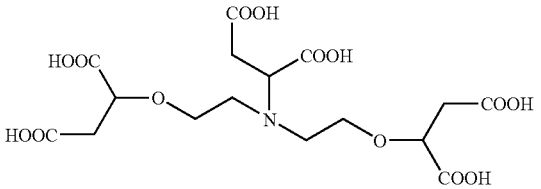

-continued

C

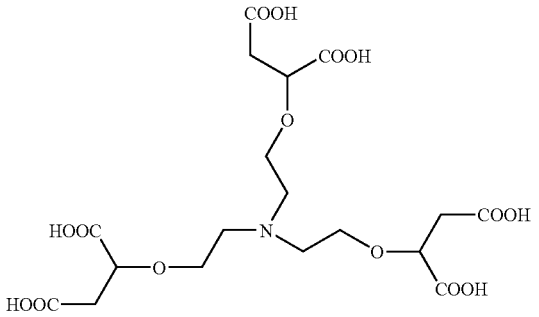

A=N-bis[2-(1,2-dicarboxy-ethoxy)ethyl]amine

B=N-bis[2-(1,2-dicarboxy-ethoxy)ethyl]aspartic acid (AES)

C=N-bis[2-(1,2-dicarboxy-ethoxy)ethyl]amine.

A preferred N-bis-(1,2-dicarboxy-ethyl)amine of formula V is the iminodisuccinic acid (ISA) having the formula

ISA

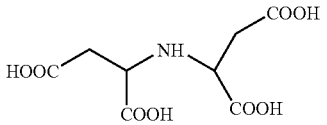

Still another preferred chelating agent is a compound having following general formula:

$$R_1C_tH_u(OH)_v(COOH)_xR_2 \qquad \text{VI}$$

wherein t is from 1 to 8, u is from 0 to 2t, v is from 0 to t, x is from 0 to 2, $R_1$ is COOH and $R_2$ is H, $CH_2OH$, or COOH.

A chelating agent of the above formula VI is hydroxycarboxylic acid not containing nitrogen or phosphorus, such as gluconic acid: t=4, u=4, v=4, x=0, $R_1$=COOH, $R_2$=$CH_2OH$ citric acid: t=3, u=4, v=1, x=1, $R_1$=COOH, $R_2$=COOH tartaric acid: t=2, u=2, v=2, x=0, $R_1$=COOH, $R_2$=COOH.

Other useful hydroxycarboxylic acids include salicylic acid.

Still another useful chelating agent is ethyleneglycol-bis (2-aminoethylether)-N,N,N',N'-tetraacetic acid (EGTA).

In addition to the above chelating agents, also saturated or unsaturated carboxylic acids such as acetic acid or maleic acid, or amino acids such as alanine, glycine or cysteine may be used as a cheating agent.

While the foregoing description presents the formulae of the chelating agents in the acid form, said agents are generally marketed as basic salts, mainly as sodium salts, and accordingly it should be understood that the formulae above represent both the free acids and salts thereof, including alkali metal such as sodium and potassium salts, and alkaline earth metal such as magnesium and calcium salts.

According to the invention, it is also possible to use a mixture of two or more chelating agents described above.

DTPA (diethylenetriaminepentaacetic acid) is a particularly preferred chelating agent.

The amount of the chelating agent is preferably at least 1.5 ppm and preferably at most 70 ppm, for example at most 50 ppm. The amount of the chelating agent may be 1.5 to 70 ppm, preferably 1.5 to 30 ppm, preferably 2 to 30 ppm, more preferably 7.5 to 15 ppm (weight/volume), based on the volume of the broke (including the aqueous phase). The amount of the chelating agent is calculated relative to the weight of the active agent. The consistency of the broke upstream of the broke thickener is typically about 1 to 3% by weight.

According to the invention, a combination of the chelating agent defined above and a dispersing agent defined below may be used.

Suitable dispersing agents soluble in water, useful for the present invention, include:

Lignosulfonates such as sodium lignosulfonate.

Condensation products of aromatic sulfonic acids with formalin such as condensed naphthalene sulfonates.

Dispersing anionic polymers and copolymers polymerized from anionic monomers, or charged to give an anionic form after polymerization. Said polymers comprise repeating units with anionic charges such as carboxylic acids, salts of carboxylic acids, sulfonic acids, salts of sulfonic acids, and/or mixtures thereof. Anionic copolymers may be produced by copolymerizing an anionic monomer with another anionic comonomer, an uncharged comonomer and/or a cationic comonomer. Anionic monomers may typically include acrylic acid, methacrylic acid, hydroxyethyl acrylate, vinyl sulfonate, 2-acrylamide-2-methylpropanesulfonic acid, styrenesulfonic acid, or salts thereof and other corresponding monomers. Polymers charged to give an anionic form only after polymerization include hydrolyzed polyacrylamides and polymers produced from maleic anhydride.

Anionic polymers may also contain different types of charged repeating units such as phosphates, like ethyleneglycol methacrylatephosphate, or phosphonic acids or salts thereof, like vinylphosphonic acid.

As examples of the anionic polymers described above,

- poly(meth)acrylates, polyacrylate-maleate, polymaleate, poly-α-hydroxyacrylic acid, polyvinylsulfonate, polystyrenesulfonate, 2-acrylamide-2-methylpropane sulfonate and polyvinyl phosphonate;
- polyphosphates like sodium hexametaphosphate;
- uncharged polymers like polyvinyl alcohol, polyvinyl pyrrolidone, polyalkoxy silanes and polyethoxy alcohols;
- cationically charged dispersing polymers like dicyandiamide-formaldehyde polymers and polyamines;

may be mentioned.

Other useful dispersing agents include polysaccharides such as native and modified starch, or modified cellulose like carboxymethyl cellulose, and derivatives thereof.

Still another useful group of dispersing agents consists of surface active compounds that may be:

- anionic, such as carboxylic acids, sulfonic acids, esters of sulfuric acid, phosphoric acids and esters of polyphosphoric acids and salts thereof,
- non-ionic, such as ethoxylated alcohols, ethoxylated alkyl phenols, ethoxylated carboxylic acid esters, and ethoxylated carboxylic acid amides,
- cationic, such as oxygen free amines, amines containing oxygen, amines with an amide bond, and quaternary ammonium salts.

It is still to be noted that in addition to the chelating property, some of the chelating agents of the invention themselves have dispersing properties.

The weight ratio of the chelating agent to the dispersing agent is preferably between 5:1 and 50:1, more preferably between 10:1 and 30:1.

The amount of the combination of the chelating agent and the dispersing agent is preferably at least 1.5 ppm and preferably at most 70 ppm, for example at most 50 ppm. The amount of the combination of the chelating agent and the dispersing agent may be 1.5 to 70 ppm, preferably 1.5 to 30 ppm, for example 2 to 70 ppm, preferably 2 to 30 ppm, more preferably 7.5 to 15 ppm (weight/volume) based on the volume of the broke (including the aqueous phase). The amount of the chelating agent and dispersing agent is calculated on the basis of weights of active agents.

The chelating agent, or the combination of the chelating agent and dispersing agent is dosed to a suitable point at the beginning of the broke system, for instance upstream of the first broke tank/broke tower, or to the first broke tank/broke tower (tower for dilute broke in FIG. 1, number 2). In case the dosage is performed upstream of the broke tank/broke tower, the suitable dosage point is one of the pulpers, pipe lines from the pulpers, or a common pipe line from the pulpers, or a pipeline for the recirculating water used for pulping (number 1 in FIG. 1). In some special cases the machine does not include a tower for dilute broke or the retention time of the broke in the first broke tank is so short that it is still possible to affect the sporulation by dosing, e.g., to the broke thickener (number 3 in FIG. 1) or to the storage tower for thickened broke (number 4 in FIG. 1).

While the chelating agent and dispersing agent may be dosed separately, they are preferably dosed as a mixture.

It is particularly preferable to perform the dosage of the chelating agent, or the combination of the chelating agent and dispersing agent on the basis of the results from on-line measurements of the transition metals.

According to the invention, it is also possible to add an oxidizing biocide in addition to the chelating agent, or the combination of the chelating agent and dispersing agent. Said oxidizing biocide may be a peracid compound such as peracetic acid, performic acid, hypochlorite, chlorinedioxide, halogenated dimethylhydantoin, ammonium bromide, chloramine, or hypobromic acid. The biocide is preferably dosed at an early stage of the broke system. In this embodiment, the addition of the chelate may also have other favorable effects. In case oxidizing biocides are used in the board machine, less performance thereof is wasted by the oxidation of metals if the concentrations of bivalent manganese other transition metals are lowered, thus improving the antimicrobial efficiency.

According to another embodiment of the invention, the transition metal content is lowered by electrochemical oxidation. Said electrochemical oxidation may be carried out for instance by varying the potential of the metal surface of the broke tank, resulting in the precipitation of manganese as oxide from the solution.

In this invention, the transition metal may comprise a bivalent transition metal, preferably bivalent manganese or bivalent iron, or bivalent manganese and bivalent iron.

According to the invention, vegetative bacterial cells are eradicated in the board or paper machine, preferably in the drying section thereof, by high temperatures.

In FIG. 1, the reference number 1 shows lines from several pulpers. Pulp from several pulpers is passed to the first broke tower 2, and further to the broke thickener 3. The thickened broke enters the tower 4 for said thickened broke, and the filtrate from the broke thickener is passed to tank 5 for recirculation to the broke system or to another suitable point. Thickened broke is passed through a screen 6 to a refiner 7, and further to the dosing chest 8 of the board machine.

Since the broke system (FIG. 1) plays a central role for the formation of spores in the board machine, the best dosage point is upstream of the first broke tower 2, either to the common line coming from different pulpers, or to several lines 1. The dosage is preferably continuous, but if possible, it is preferable to connect the control of the set values of the dosage pumps to flows from different pulpers. The dosage amounts may vary between 2 and 70 ppm, preferably 2 and 30 ppm, and more preferably 7.5 and 15 ppm (weight/volume) of the chelate, or 2 and 70 ppm, preferably 2 to 30 ppm, and more preferably 7.5 to 15 ppm (weight/volume) of the combination of the chelate and dispersing agent.

The dosage may also for instance be carried out right away to the pulper or directly to the first tower 2 of the broke recirculation. The dosage may also be carried out to a another stage of the broke recirculation such as to the broke thickener 3, water 5 filtered from the broke, or to the tower of the thickened broke, such dosage, however, not necessarily resulting in the prevention of the sporulation as efficiently as the dosage to an earliest possible stage of the broke recirculation.

The invention is now described in more detail by means of examples.

EXAMPLE 1

In this laboratory experiment, the effect of bivalent manganese and bivalent iron as well as a chelating agent (DTPA, diethylenetriaminepentaacetic acid) on the sporulation of bacilli isolated from a board machine was studied under conditions of the broke system. For the experiment, an inoculum free of spores was prepared from the *Bacillus licheniformis* 217 strain by carrying out three consecutive cultivations in a liquid medium for 24 hours (Tryptone-Yeast Extract Medium, +50° C., agitation at 100 rpm) using a low inoculation ratio (0.1% by volume/volume). Broke free of spores was produced by sterilizing dilute broke of the board machine. A low amount of spray starch used in the board machine was added to the broke to make up for the amount of starch consumed by bacterial activity during the transportation of the broke sample to the laboratory. The broke was divided into aliquots of 25 ml each and filled in tubes, followed by the addition of the test agents at different concentrations. 0.2% stock solutions of manganese ($Mn(II)Cl_2 \times 4H_2O$) and iron ($Fe(II)SO_4 \times 7H_2O$) in deionized water were sterile filtered using 0.2 μm spray filters. 25 μl of the *Bacillus* culture free of spores were added to each tube, followed by keeping the tubes at 45° C. (agitation at 100 rpm). The amounts of aerobic bacteria and aerobic spores in each tube were determined after different exposure times. The amount of aerobic bacteria were determined by a filtering method, whereas aerobic spores were determined from pasteurized (20 min, 80° C.) samples using the pour plate method (Plate Count Agar in both cases, 45° C., 3 d).

Figure 2:
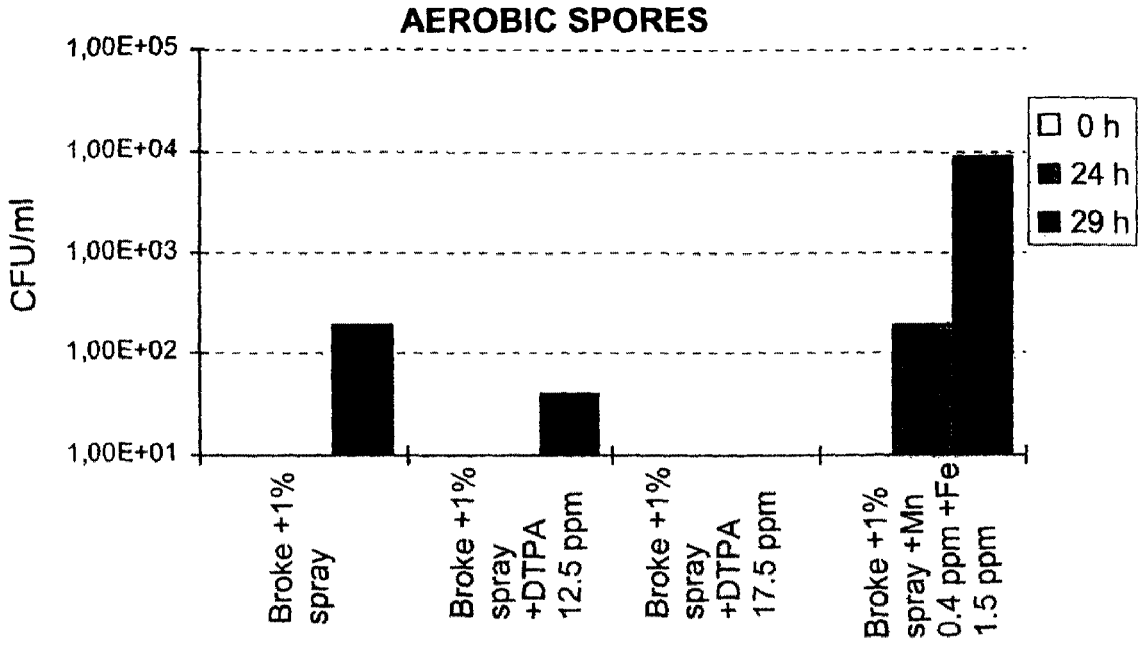
FIG. 2 shows the formation of aerobic spores in the broke of a board machine as a function of time, and further, the effect of bivalent manganese, bivalent iron and DTPA thereon.

The results are presented in FIG. 2. In the control sample without any other additions except for spray starch, no spores were formed after 24 hours, whereas 190 spores per ml were found after 29 hours. At the same moment, the aerobic bacterial amount (not shown) was 110,000 CFU/ml, that is the sporulation frequency was as low as 0.17%. Based on these results, the conditions in the broke were not particularly favorable for sporulation. Addition of metals boosted sporulation. For instance the addition of 0.4 ppm (Mn(II)+1.5 ppm Fe(II) to the broke resulted in the formation of mature spores already in 24 hours. At the end of the test (29 h), spore count was 9,000 CFU/ml, the increase being thus 98% in comparison to the control, while the sporulation frequency was 10%. The addition of a chelating agent (DTPA) in an amount of 12.5 ppm (as active agent) reduced sporulation by 79%, whereas an addition of 17.5 ppm resulted in total inhibition.

EXAMPLE 2

In this laboratory experiment, the effect of a test product C containing a dispersing agent and DTPA on sporulation of bacilli isolated from a board machine was studied under the conditions in the broke system. The composition of the test product C was as follows: 40% (weight/volume) of pentasodium salt of the diethylenetriaminepentaacetic acid (DTPA), 2% (weight/volume) of sodium gluconate, and 2% (weight/volume) of naphthalenesulfonate (condensation polymer of naphthalenesulfonic acid and formaldehyde). The study was carried out as the study in example 1 except for the fact that the inoculum was cultivated at +45° C., without the addition of spray starch to the broke.

Figure 3:
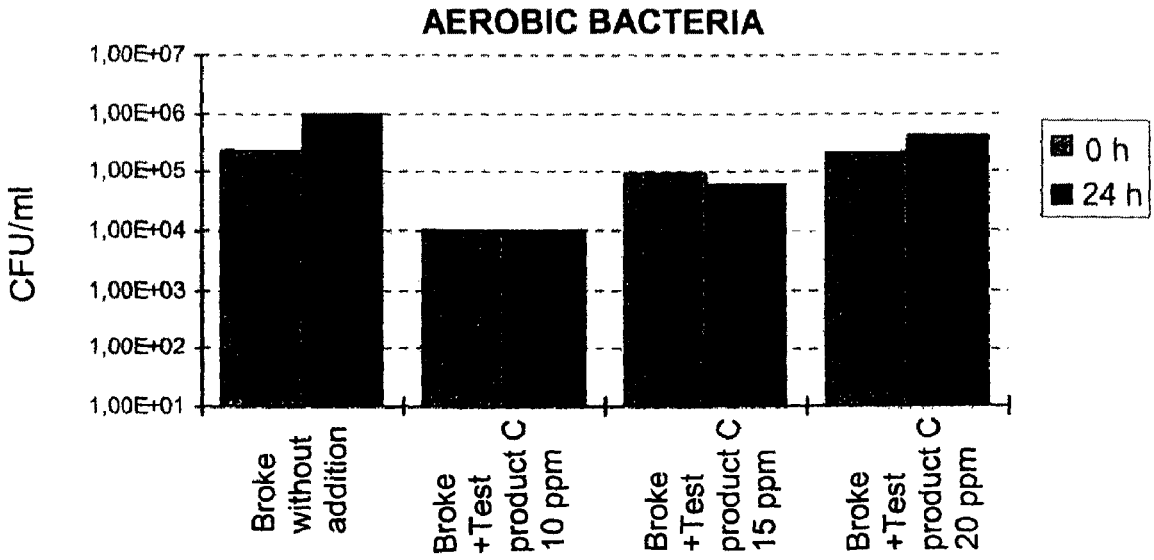
FIG. 3 shows the effect of the additions of the test product C on the aerobic bacterial amount in the broke of a board machine as a function of time.
Figure 4:
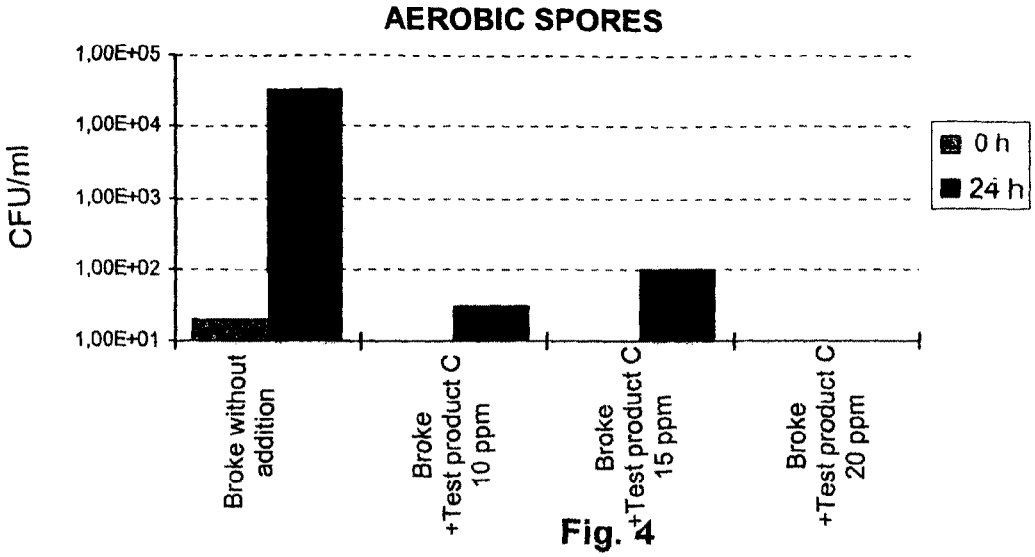
FIG. 4 shows the formation of aerobic spores in the broke of a board machine as a function of time, and further, the efficiency of the test product C.

The test results are presented in FIGS. 3 and 4. In this experiment, 32,000 spores/ml were formed in the control sample (broke without any additives), sporulation frequency being thus 3.2%. This suggests that the conditions in this broke were more favorable for the sporulation of bacilli than in the broke sample used in the experiment of example 1. As may be seen from FIG. 3, the test product C was not toxic to the bacilli but, however, clearly reduced sporulation (FIG. 4). For instance in case of the addition of the test product in an amount of 10 ppm (4.4 ppm of the active agent) to the broke resulted in sporulation of only 30 CFU/ml. Based on these results, sporulation was reduced by about 99.9% by the addition of 10 ppm of the test product, whereas 20 ppm resulted in total inhibition thereof (<10 CFU/ml). Sporulation frequencies were 0.3%, 0.17% and <0.0024% for additions of 10,15, and 20 ppm, respectively, of the test product.

EXAMPLE 3

In this laboratory experiment, the effect of bivalent manganese and bivalent iron, DTPA, and test product C containing a dispersing agent and DTPA on sporulation of bacilli in the broke of a board machine isolated therefrom was studied. The study was performed as in example 2.

Figure 5:
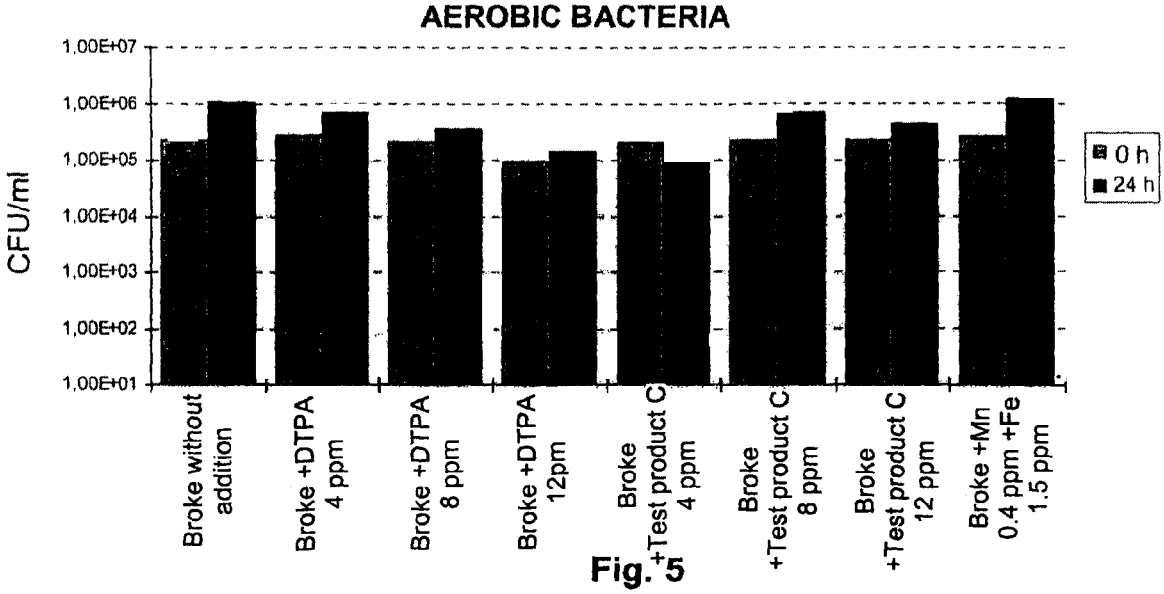
FIG. 5 shows the effect of the additions of metals, DTPA, and the test product C on the amount of aerobic bacteria in the broke of a board machine as a function of time.
Figure 6:
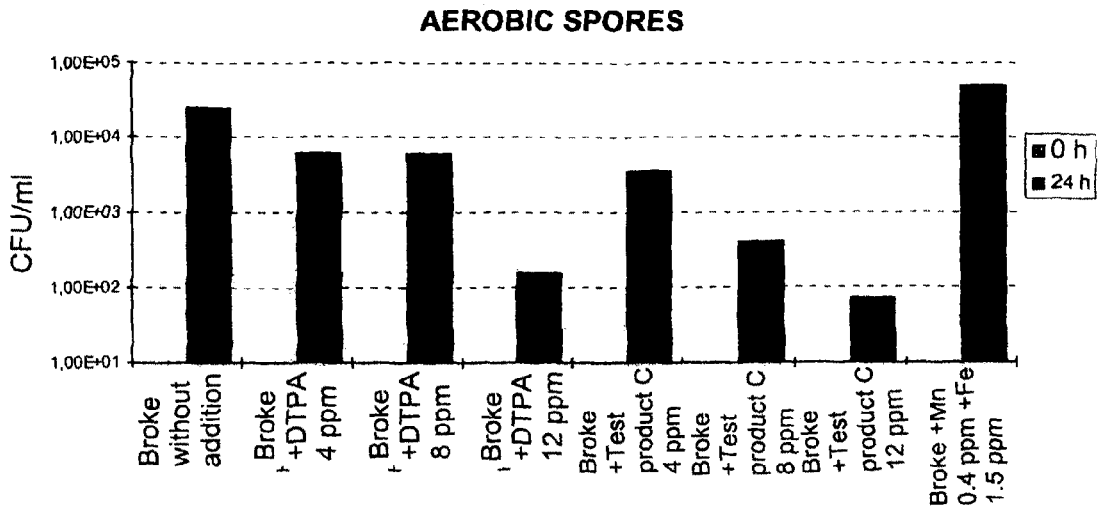
FIG. 6 shows the formation of aerobic spores in the broke of a board machine as a function of time, and further, the efficiency of metals, DTPA, and the test agent C.

The test results are shown in FIGS. 5 and 6. In this experiment, the spore amount after 24 hours was 25,000 spores/ml for the control sample (broke without any addition), sporulation frequency being 2.3%. This suggests that the conditions in the broke were rather favorable for sporulation of bacilli without further additions. The addition of bivalent transition metals to the broke resulted in doubling of the number of spores generated, sporulation frequency being 4.2%. FIG. 5 shows that neither DTPA nor the test product C was toxic to bacilli. FIG. 6 shows that 12 ppm of DTPA (as active agent) lowered both sporulation by 99.4% and sporulation frequency (to 0.11%). The test product C was still more efficient, 8 ppm thereof (as product) reduced sporulation by 98.4% (sporulation frequency of 0.06%), while 12 ppm thereof reduced sporulation by 99.7% (sporulation frequency only of 0.016%). The results suggest that sporulation was inhibited more efficiently by the combination of the dispersing agent and DTPA (test product C) than DTPA alone.

EXAMPLE 4

In this laboratory experiment, the effect of bivalent manganese and iron, and test product C containing a dispersing agent and DTPA on sporulation of bacilli in the broke of a board machine isolated therefrom was studied. The study was performed as the study in example 2.

Figure 7:
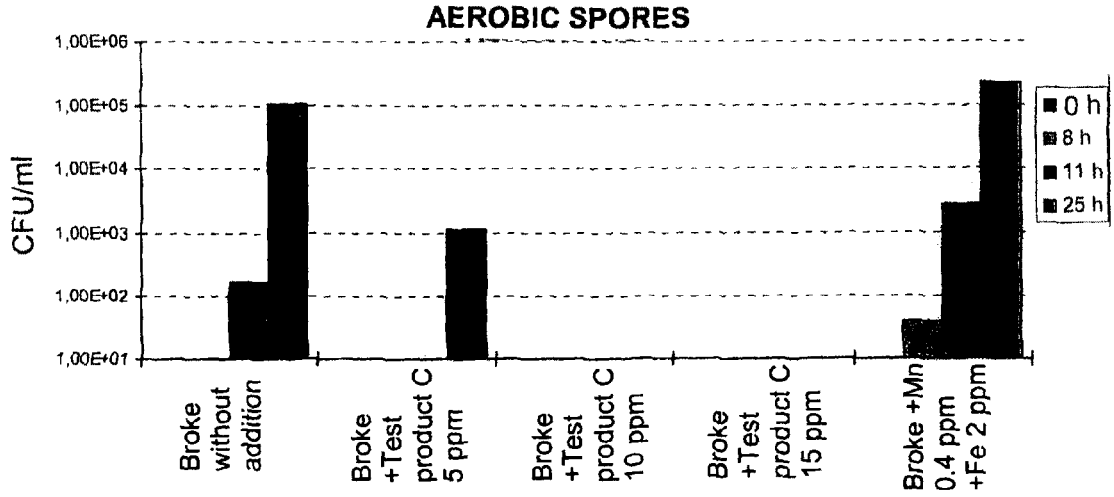
FIG. 7 shows the formation of aerobic spores in the broke of a board machine as a function of time, and further, the efficiency of the metals and the test product C.

The test results are shown in FIG. 7. In this experiment, first mature spores appeared in the control sample (broke without addition) in 11 hours after initiation of the test. In 24 hours, 101,000 spores/ml were found in the control sample, sporulation frequency being 45%. This suggests that the conditions in said broke sample were very favorable for sporulation. Under these conditions, the sporulation frequency was no longer increased by the addition of Mn(II)+Fe(II), but however, maturation of the spores was accelerated by the addition of the metals. Addition of 5 ppm of the test product C (2.2 ppm as active agents) resulted in delay of sporulation: after 11 hours, no mature spores were present in the sample, and after 25 hours, the sporulation was reduced by 99% in comparison to the control (FIG. 7). Sporulation was totally inhibited by the addition of 10 ppm of the test product C (frequency of sporulation <0.06%).

EXAMPLE 5

In this field test, a sample was taken from the tower of the dilute broke of a board machine, the sample was fractioned and introduced into 10 tubes, respectively, and various amounts of the test product C were added thereto. The tubes were incubated at 45° C., followed by determination of the aerobic bacterial and spore amounts after exposure times of different lengths. During the test, sporulation in the dilute broke was slow, as indicated by spore amounts of about 50 CFU/ml in all samples, that is, the initial level. Next morning (43 h), great amounts of mature spores were measured from the untreated samples. Results are shown in table 1. Based on the results, the test product C had no effect on aerobic bacterial amounts (non-biocide product). However, sporulation was considerably reduced by a dose of 15 mg/l, and inhibited by doses of ≧20 ppm. Following this measurement, 0.3 ppm Mn(II) and 0.9 ppm Fe(II) were added to all samples. This addition considerably increased sporulation, suggesting that manganese and iron are limiting factors for sporulation.

TABLE 1

| Conc. of test | CFU/ml after 43 h | | CFU/ml after addition of Mn + Fe | |
|---|---|---|---|---|
| product C mg/l | Aerobic bacteria | Aerobic spores | Aerobic bacteria | Aerobic spores |
| 0 | 8,800,000 | 6,600 | 6,100,000 | 16,800 |
| 5 | 5.600,000 | 6,000 | 4,200,000 | 17,000 |
| 10 | 5,800,000 | 6,200 | 6,000,000 | 11,000 |
| 15 | 8,900,000 | 300 | 4,600,000 | 3,900 |
| 20 | 6,000,000 | 77 | 4,400,000 | 2,600 |

EXAMPLE 6

This study was performed in order to compare different chelating agents. A sample was collected from broke tower of a food-packaging board producing machine. The broke sample was divided in 6 tubes. One of these was not dosed with any chemical, two were dosed with test product A and three were dosed with test product D, and the samples were incubated 1d at 45° C. (the temperature of the broke tower of that machine). As the active chelating agent the product A included diethylenepentakis-methylenephoshonic acid (DTPMPA; 45%), and product D N-bis-[2-(1,2-dicarboxy-ethyloxy)-ethyl]-aspartic acid (AES; 25%). Cultivations were performed on standard Plate Count Agar: total aerobic bacteria at 45° C. an aerobic spores at +37° C. Results are shown in FIGS. 8 and 9.

Figure 8:
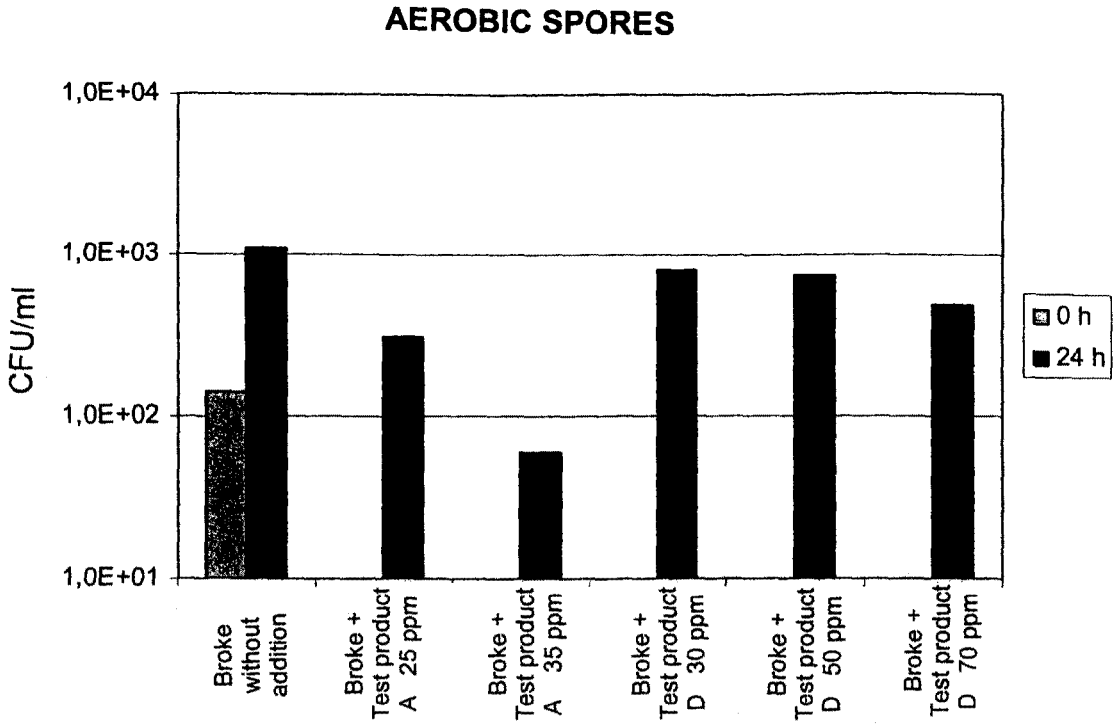
FIG. 8 shows the formation of aerobic spores in the broke of a board machine as a function of time, and further, the efficiency of the test products A and D.
Figure 9:
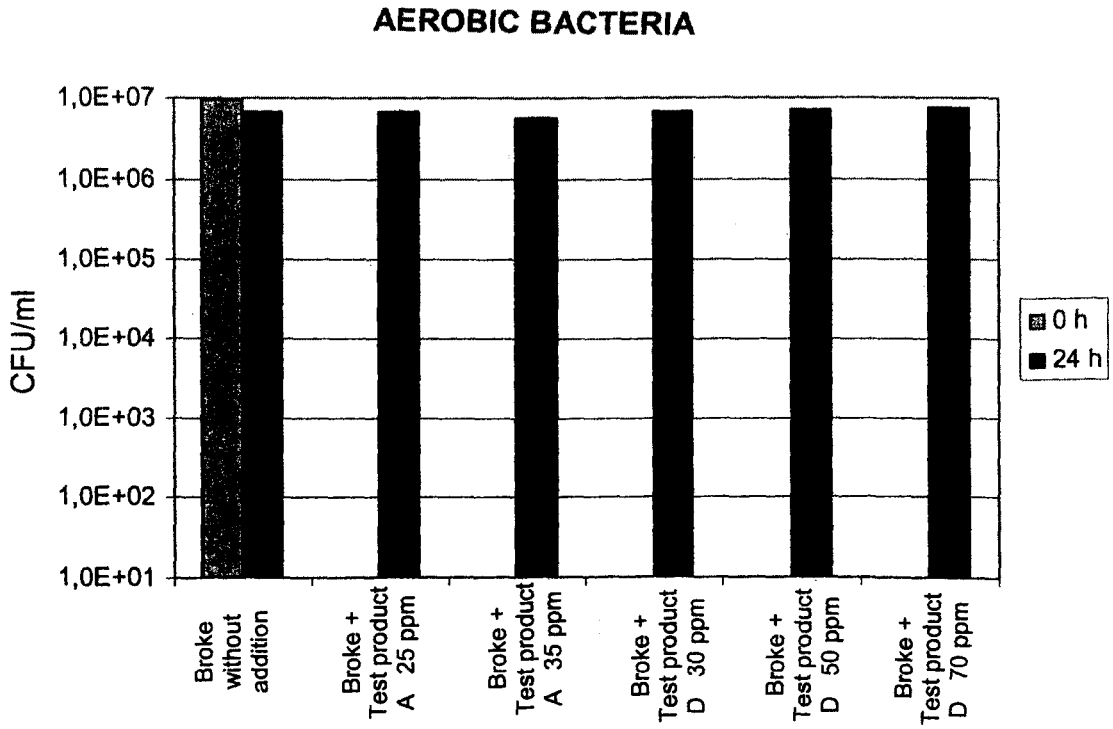
FIG. 9 shows the effect of the addition of the test products A and D on the amount of aerobic bacteria in the broke of a board machine as a function of time.

In the beginning of the test (0 h) the broke contained aerobic bacterial spores 140 CFU/ml (FIG. 8). In the untreated sample, during one day of incubation at 45° C. the spore amount increased to 1085 CFU/ml. FIG. 8 shows that 35 ppm of product A prevented bacterial sporulation totally (no new spores were formed) and 25 ppm reduced spore formation markedly compared to the untreated sample. Also product D reduced the spore amount, but the highest tested concentration did not completely block spore formation.

The results clearly showed that also other chelating agents than DTPA can prevent spore formation. Again, none of the tested agents reduced the amount of vegetative aerobic bacteria, and thus the mechanism of action in preventing spore formation is not biocidal (FIG. 9).

EXAMPLE 7

A full scale trial was performed in a three-ply board machine producing board for food packaging. The target was to lower the amount of aerobic bacterial spores in the final board. Test product C was dosed continuously to the couch pit (beginning of the broke system) at a rate of 6 l/h. Aerobic bacterial spores were quantified from the whole broke system (following the flow from the couch pit to broke tower and ultimately to the broke dosing chest) and from the final board product before, during and after the trial run. In the days preceding the trial, the spore content in broke increased 2.5 to 4.5 fold during the broke flow through the system, resulting in up to 210-460 spores per 1 ml of broke in the dosing chest. During the trial spore content gradually diminished. For example, in the 3$^{rd}$ day of the trial, spore amounts remained the same through the whole broke system. Thus no new spores were formed anymore during the time that the broke remained in the broke system. When the trial was paused, with a delay of one day this resulted in 3.5 fold higher spore amounts in the broke dosing chest and logically also in higher spore counts in the final board. In conclusion, the trial showed a 70% decrease in the amounts of aerobic bacterial spores in the final board of food packaging grade.

REFERENCES

Charney, J., Fisher, W. P. and C. P. Hegarty. 1951. Manganese is an essential element for sporulation in the genus *Bacillus*. Journal of Bacteriology 62: 145-148.

Fortnagel, P. and E. Freese. 1968. Inhibition of aconitase by chelating of transition metals causing inhibition of sporulation in *Bacillus subtilis*. The Journal of Biological Chemistry 243: 5289-5295.

Francis, C. A. and B. M. Tebo. 2002. Enzymatic manganese (II) oxidation by metabolically dormant spores of diverse *Bacillus* species. Applied and Environmental Microbiology 68: 874-880.

Fujita, M., Gonzáles-Pastor, J. and R. Losick. 2005. High- and low-threshold genes in the Spo0A regulon of *Bacillus subtilis*. Journal of Bacteriology 187: 1357-1368.

González-Pastor, J., Hobbs, E. and R. Losick. 2003. Cannibalism by sporulating bacteria. Science 301: 510-513.

Inaoka, T., Matsumura, Y. and T. Tsuchido. 1999. SodA and manganese are essential for resistance to oxidative stress in growing and sporulating cells of *Bacillus subtilis*. Journal of Bacteriology 181: 1939-1943.

Kujala, M., Sillanpää, M. ja J. Rämö. 2004. A Method to leach manganese and some other metal cations from pulp matrix to aqueous phase for the subsequent ICP-AES analysis: a potential tool for controlling the metal profile in a pulp bleaching process. Journal of Cleaner Production 12: 707-712.

Que, Q. and J. D. Helmann. 2000. Manganese homeostasis in *Bacillus subtilis* is regulated by MntR, a bifunctional regulator related to the diphtheria toxin repressor family proteins. Molecular Microbiology 35: 1454-1468.

Turner, N. A., Harris, J., Russel, A. D. and D. Lloyd. 2000. Microbial differentiation and changes in susceptibility to antimicrobial agents. Journal of Applied Microbiology 89: 751-759.

Vasantha, N. and E. Freese. 1979. The role of manganese in growth and sporulation of *Bacillus subtilis*. Journal of General Microbiology 112: 329-336.

The invention claimed is:

1. Method for preventing or delaying bacterial sporulation in the broke system of a board or paper machine, wherein the method comprises the step of lowering the content of transition metals in the broke by chelation to a level unfavorable for sporulation;

said procedure used for lowering the content of the transition metals not substantially killing bacterial cells present in the broke system of the board or paper machine.

2. Method of claim 1, wherein the content of the transition metals is lowered by chelation carried out with a chelating agent.

3. Method of claim 2, wherein said chelating agent has the following general formula:

I

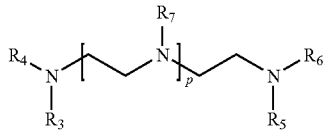

wherein p is 0 or an integer from 1 to 10, $R_3$, $R_4$, $R_5$, $R_6$, and $R_7$ are independently a hydrogen atom or an alkyl chain with 1 to 6 carbon atoms, containing an active chelating ligand such as a carboxylic acid, a phosphonic acid, a hydroxyl group, or a salt thereof.

4. Method of claim 2, wherein said chelating agent has the following general formula:

II

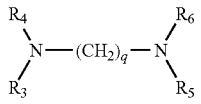

wherein q is an integer from 3 to 10, $R_3$, $R_4$, $R_5$, and $R_6$ are independently a hydrogen atom or an alkyl chain with 1 to 6 carbon atoms, containing an active chelating ligand such as a carboxylic acid, a phosphonic acid, a hydroxyl group, or a salt thereof.

5. Method of claim 2, wherein said chelating agent has the following general formula:

IV

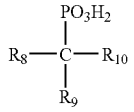

wherein $R_8$ represents a hydrogen atom, an alkyl group with 1 to 6 carbon atoms, or an alkyl chain with 1 to 6 carbon atoms, containing a carboxylic acid, a phosphonic acid, or a hydroxyl group, $R_9$ represents a hydrogen atom, hydroxyl group, phosphonic acid group, carboxylic acid group, or an alkyl chain with 1 to 6 carbon atoms, containing one or two carboxylic acid groups, and $R_{10}$ represents a hydrogen atom, hydroxyl group, carboxyl group, an alkyl group with 1 to 6 carbon atoms, or an alkyl chain with 1 to 6 carbon atoms, containing a carboxyl group or a salt thereof.

6. Method of claim 2, wherein said chelating agent has the following general formula:

V

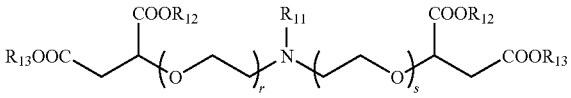

wherein $R_{11}$ represents a hydrogen atom, an alkyl chain with 1 to 30 carbon atoms, an alkyl chain with 1 to 30 carbon atoms and with 1 to 10 carboxylic acid groups bound to said chain, or an alkali metal or alkaline earth metal salt thereof, an alkyl chain with 1 to 30 carbon atoms and with 1 to 10 carboxylic acid ester groups bound to said chain, a (poly)ethoxylated hydrocarbon chain with 1 to 20 ethoxyl groups, or a carboxylic acid amide with 1 to 30 carbon atoms, wherein the N—$R_{11}$-bond is an amide bond, $R_{12}$ and $R_{13}$ are: hydrogen, an alkali metal ion or an alkaline earth metal ion or an alkyl group having 1 to 30 carbon atoms, r is 0 or 1, and s is 0 or 1, or a salt thereof.

7. Method according to claim 2, wherein the amount of the chelating agent is preferably between 2 and 70 ppm (weight/volume), based on the volume of the aqueous broke.

8. Method according to claim 2, wherein the chelating agent is combined with a dispersing agent to produce a combination of the chelating agent and the dispersing agent.

9. Method according to claim 8, wherein the weight ratio of the chelating agent to the dispersing agent varies between 5:1 and 50:1.

10. Method according to claim 8, wherein the amount of the combination is between 2 and 70 ppm (weight/volume) based on the volume of the aqueous broke.

11. Method according to claim 2, wherein the chelating agent, or the chelating agent in combination with a dispersing agent, is dosed upstream of a broke tank.

12. Method according to claim 1, wherein said transition metal comprises bivalent manganese, or bivalent iron, or a combination of bivalent manganese and bivalent iron.

13. Method for producing packaging board or packaging paper, wherein broke is used in producing the packaging board or packaging paper, comprising the steps of:

lowering the content of transition metals in the broke to a level unfavorable for sporulation, said procedure not substantially killing bacterial cells present in the broke system of the board or paper machine; and producing packaging board or packaging paper.

14. Method of claim 13, wherein the content of transition metals is lowered by chelation with a chelating agent or a combination of a chelating agent and a dispersing agent, or by electrochemical oxidation.

15. Method of claim 1, wherein the content of the transition metals is lowered by electrochemical oxidation.

16. Method of claim 14, wherein the dosage of the chelating agent or the combination of the chelating agent and dispersing agent is performed on the basis of the results from on-line measurements of the transition metal.

17. Method of claim 14, wherein the chelating agent or the combination of the chelating agent and the dispersing agent is dosed upstream of a broke tank.

18. Method of claim 13, wherein the packaging board is a food packaging board.

19. Method for preventing or delaying bacterial sporulation in the broke system of a board or paper machine, comprising the steps of:

contacting a chelating agent with a broke in the broke system; and binding transition metals in the broke with said chelating agent, thereby lowering the content of transition metals to a level unfavorable for sporulation, said procedure used for lowering the content of the transition metals not substantially killing bacterial cells present in the broke system of the board or paper machine.

20. Method for producing packaging board or packaging paper, wherein broke is used in producing the packaging board or packaging paper, comprising the steps of, contacting a chelating agent with a broke in the broke system;

binding transition metals in the broke with said chelating agent, thereby lowering the content of transition metals to a level unfavorable for sporulation, said procedure used for lowering the content of the transition metals not substantially killing bacterial cells present in the broke system of the board or paper machine; and producing packaging board or packaging paper.

* * * * *